US006866545B2

(12) United States Patent
Glasson

(10) Patent No.: US 6,866,545 B2
(45) Date of Patent: Mar. 15, 2005

(54) ELECTRICAL CORDSET WITH INTEGRAL SIGNAL CONDITIONING CIRCUITRY

(75) Inventor: Richard Glasson, Whippany, NJ (US)

(73) Assignee: Control Products, Inc., (US)

( * ) Notice: Subject to any disclaimer, the term of this patent is extended or adjusted under 35 U.S.C. 154(b) by 0 days.

(21) Appl. No.: 10/385,368

(22) Filed: Mar. 10, 2003

(65) Prior Publication Data

US 2004/0180579 A1 Sep. 16, 2004

(51) Int. Cl.[7] ..... H01R 9/03

(52) U.S. Cl. ..... 439/610; 439/502; 439/913; 92/5 R

(58) Field of Search ..... 439/610, 501–505, 439/76.1, 913; 92/5 R

(56) References Cited

U.S. PATENT DOCUMENTS

| | | | | |
|---|---|---|---|---|
| 3,403,365 A | | 9/1968 | Richards | |
| 4,121,504 A | | 10/1978 | Nowak | |
| 4,231,700 A | | 11/1980 | Studebaker | |
| 4,286,386 A | | 9/1981 | Long | |
| 4,288,196 A | | 9/1981 | Sutton, II | |
| 4,319,864 A | | 3/1982 | Kaufeldt | |
| 4,386,552 A | | 6/1983 | Foxwell | |
| 4,480,151 A | | 10/1984 | Dozier | |
| 4,945,221 A | | 7/1990 | Nielsen et al. | |
| 4,989,329 A | | 2/1991 | Pullen | |
| 5,024,250 A | | 6/1991 | Nakamura | |
| 5,043,949 A | * | 8/1991 | Shechter | 367/76 |
| 5,046,243 A | | 9/1991 | Walker | |
| 5,203,723 A | | 4/1993 | Ritter | |
| 5,341,684 A | * | 8/1994 | Adams et al. | 73/756 |
| 5,341,724 A | | 8/1994 | Vatel | |
| 5,404,661 A | | 4/1995 | Sahm et al. | |
| 5,694,042 A | | 12/1997 | Eaton et al. | |
| 5,701,793 A | | 12/1997 | Gardner et al. | |
| 5,724,813 A | * | 3/1998 | Fenelon et al. | 60/606 |
| 5,752,811 A | | 5/1998 | Petro | |
| 5,885,108 A | * | 3/1999 | Gerrans, Jr. | 439/606 |
| 6,123,578 A | * | 9/2000 | Truett | 439/551 |
| 6,234,061 B1 | * | 5/2001 | Glasson | 92/5 R |
| 6,488,116 B2 | * | 12/2002 | Bailey | 181/108 |
| 6,702,600 B2 | * | 3/2004 | Glasson | 439/190 |

FOREIGN PATENT DOCUMENTS

| | | |
|---|---|---|
| DE | 2635614 | 2/1978 |
| DE | 3835782 | 4/1990 |
| EP | 0325787 | 8/1993 |
| EP | 0505297 | 8/1993 |
| FR | 2794236 | 12/2000 |

* cited by examiner

*Primary Examiner*—Tho D. Ta
*Assistant Examiner*—X. Chung-Trans
(74) *Attorney, Agent, or Firm*—Gibbons, Del Deo, Dolan, Griffinger and Vecchione

(57) ABSTRACT

An electrical cordset for connecting a sensor connector used with a piston position sensor located within a high pressure environment and a control system. The cordset is an electrical conductor having a standard industry connector to connect to the sensor connector and includes a casing intermediate the ends of the cordset to contain and seal therein signal conditioning circuitry to condition signals passing through the electrical conductor. The signal conditioning circuitry includes a circuitboard and a potting compound fills the casing and seals the signal conditioning circuitry fully within the casing to protect the circuitry from the hostile external environment and affix the electrical conductor to the casing. The affixation of the casing to the electrical conductor is further accomplished by use of grommets that are sealed to the electrical conductor and interfit within openings in the casing.

17 Claims, 3 Drawing Sheets

ELECTRICAL CORDSET WITH INTEGRAL SIGNAL CONDITIONING CIRCUITRY

FIELD OF THE INVENTION

The invention generally relates to electrical cordsets and, more particularly to a cordset that provides communication between a sensor and a control system with intermediate electronic circuitry integrally disposed in the cordset.

BACKGROUND

There are many different types of electrical cordsets that are used in a wide abundance of differing environments and applications. One rather specialized environment for such cordsets is, however, where there is a high pressure application or hostile environment. An example of such an application is in the use of a position sensor where a sensor is located within a hydraulic or pneumatic cylinder, typically used with outdoor heavy construction equipment, to sense the position of a piston moving within the cylinder. Such sensors are subjected to the high pressures internal of the cylinder and the signals from that internal sensor must be transmitted to a control system that provides power to the sensor while receiving the sensed signals from that sensor to determine the position of the piston within the cylinder. The sensor itself is in a very hostile environment as is the particular heavy construction equipment and, therefore, it is mandatory that a cordset connecting the sensor within that environment to the control system also be capable of withstanding the external environment while reliably transmitting the electrical signals.

One such sensor used in that environment is shown and described in pending U.S. patent application Ser. No. 09/793,218 entitled "PRECISION SENSOR FOR A HYDRAULIC CYLINDER" and which, in turn, is a continuation-in-part of U.S. Pat. No. 6,234,061, issued on May 22, 2001, entitled "PRECISION SENSOR FOR A HYDRAULIC CYLINDER" and which was based upon U.S. Provisional application 60/104,866 filed on Oct. 20, 1998 and the disclosure of all of the foregoing applications and issued U.S. patent are hereby incorporated into this specification by reference.

In the aforedescribed patent application, there is a high pressure sensor connector having various male conductive pins that is provided at the sensor and sealed within the cylinder wall. It is necessary to have a cordset to electrically connect that sensor connector to the control system that is located external of the hydraulic component so that the signals from the sensor can be reliably transmitted between that sensor and the control system that both provides power to the sensor and receives the position sensing signals from the sensor to interpret and use those signals in the operation and control of the equipment.

One of the difficulties with such systems, therefore, is the necessity to have a reliable and rugged electrical connection between that sensor that is located within the hydraulic or pneumatic cylinder and the control system that is located external of the cylinder. The connection must be secure and often must conform to small physical space constraints and yet be able to withstand the rather hostile environment that is present with such equipment.

Further problems arise in that the electrical connection must be designed to minimize the effects of electromagnetic interference on the signals passing through the cordset as well as those previously mentioned conditions of weather, chemicals, extreme temperatures and damage due to contact with other objects in the work environment.

As a further consideration, the electrical connection or cordsets must be economical to produce as they are used in a cost-competitive industry and therefore must be able to fulfill all of the aforedescribed requirements while still being inexpensive to manufacture.

One additional consideration in the providing of a cordset to the aforedescribed application is that there needs to be certain signal conditioning circuitry to alter or condition the signals passing through the cordset and, while one solution could be to locate such circuitry on or within the equipment itself, it would be advantageous if the particular signal conditioning circuitry be a part of the cordset that would be easy to replace when necessary and in a less hostile environment.

SUMMARY OF THE INVENTION

An electrical cordset according to the principles of the present invention provides a robust electrical connection between a sensor connector leading to the sensor located within the hydraulic or pneumatic cylinder and the connector of an electrical control system located external of the cylinder. In one embodiment, one, and more preferably, both of the electrical connectors at the ends of the cordset are industry standard connectors for economy, convenience and to be readily usable for the intended purpose.

Thus, the present cordset provides a solid, reliable electrical connection between the sensor connector and a connector on the electronic control circuitry and which comprises an electrical conductor that is encased within a insulating external covering to protect the individual electrical wires against the hostile environment. A casing is located in the cordset intermediate the ends thereof and which contains the signal conditioning circuitry, in the form of a printed circuitboard as well as various electronic components along with the connections for such components and circuitboard to the electrical conductor that passes through the casing.

In one embodiment, there is electrical shielding provided along the length of the electrical connector and the casing is constructed of an electrically conductive material, such as metal, and more specifically, a stamped metal casing, that is electrically connected to the shielding so that the shielding protection is afforded to the cordset along the full length thereof.

In the affixation of the casing to the electrical conductors, the casing itself can be an elongated configuration having openings, such as C-shaped openings, at each of the opposite ends thereof. Thus, grommets can be affixed firmly to the electrical conductor with the grommets having peripheral slots that slide into the C-shaped openings to firmly secure the electrical conductor to the casing in a secure, tight relationship. Alternatively, the openings can be circular with round grommets that are inserted into the openings.

After the wiring and connecting of the signal conditioning circuitry within the casing, there can be a number of pins on the printed circuitboard that extend outwardly from the casing for testing of the circuitry and those pins can readily be cut off when the testing is completed Thereupon, a potting compound is introduced into the casing such that the potting compound covers and fully seals the signal conditioning circuitry such that all of the circuitry, printed circuitboard and electrical connections are fully immersed in the potting compound. The potting compound then hardens to provide a sealed casing containing the signal conditioning circuitry that is sealingly affixed to and is an integral part of the cordset with an electrical connector at each end of the cordset.

BRIEF DESCRIPTION OF THE DRAWINGS

A more complete understanding of the invention may be obtained from consideration of the following description in conjunction with the drawings in which.

DETAILED DESCRIPTION

Figure 1:
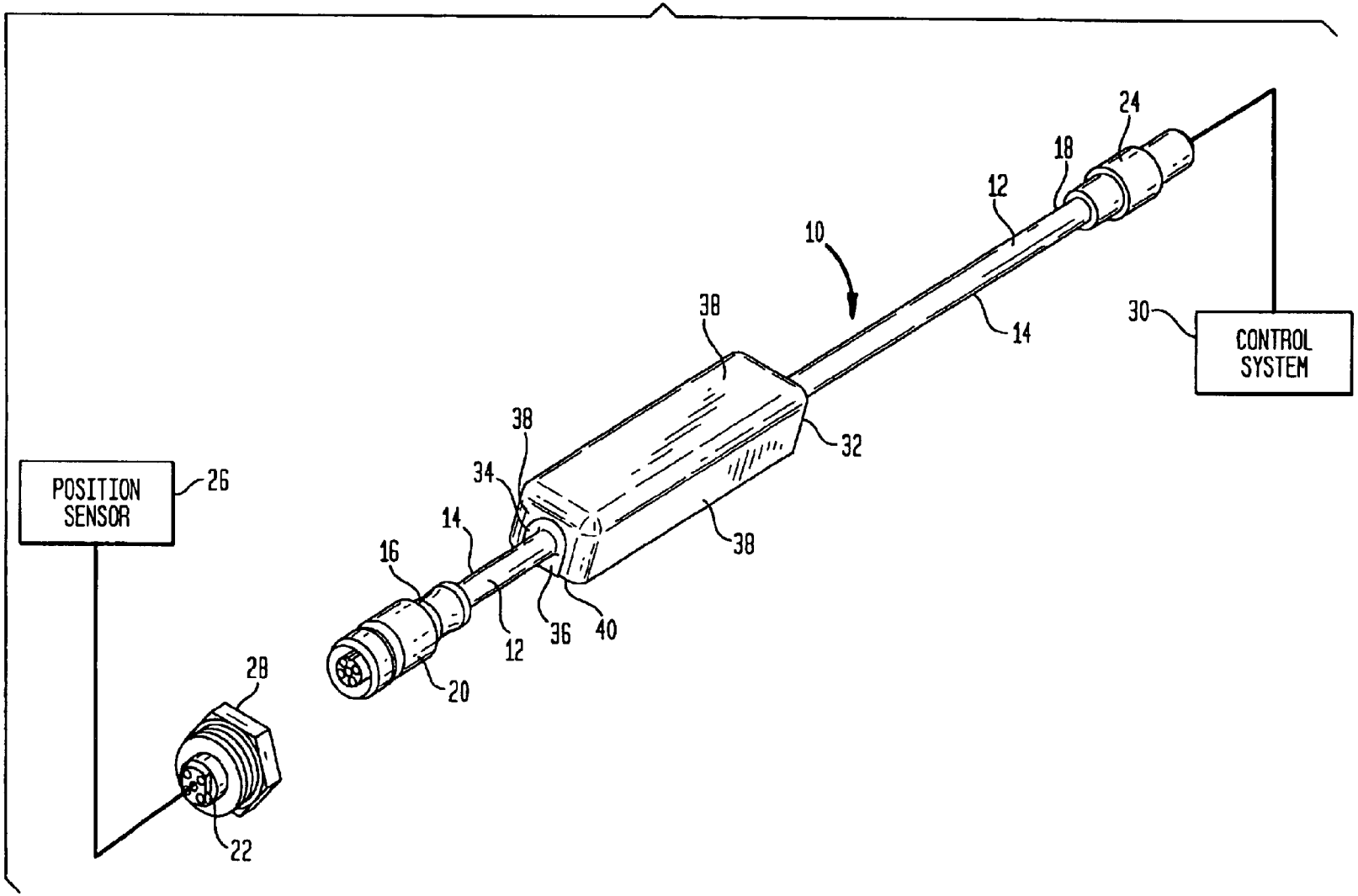
FIG. 1 is a perspective view of a cordset constructed in accordance with the present invention.

In FIG. 1, there is shown a perspective view of a cordset 10 constructed in accordance with the principles of the present invention. As can be seen, the cordset 10 includes a electrical conductor 12 that basically comprises a plurality of individual wires, (not shown) and which also has an outer covering 14 that is water proof and which protects the individual wires from the surrounding environment. There is also an electrical shielding located internal of the outer covering 14 that shields the individual wires against the effects of electromagnetic interference.

The electrical conductor 12 has a first end 16 and a second end 18. At the first end 16 there is affixed a first connector 20 that is preferably a standard industry connector and which is adapted to be connected to a sensor connector 22. In the preferred embodiment, the first connector 20 is a five pin connector that is a standard connector in the industry and identified as an M12 connector.

At the second end 18 of the electrical conductor 12 there is a second connector 24 that also can be an industry standard connector in order to make the cordset 10 adaptable for various applications as well as to lower the manufacturing costs of the cordset 10. The second connector 24 can be the same standard industry connector that is used on the first end 16, that is, a M12 connector.

As stated, the present cordset 10 is specially adapted to be used with a position sensor such as is shown and described in U.S. Pat. No. 6,234,061 and the co-pending U.S. patent application patent application Ser. No. 09/793,218 such the first connector 20 is a female connector that electrically connects to the sensor connector 22 and which is positioned within the wall of a cylinder to connect with a position sensor 26 as described in the aforementioned U.S. patent and patent application. The position sensor 26 itself, therefore, is located within a cylinder and subjected to the high pressure environment within that cylinder in detecting the position of a piston moving therein and in the construction thereof, the sensor connector 22 is sealed within a fitting 28 to sealingly affix that sensor connector 22 within the wall of the cylinder.

The second connector 24, likewise, as used in the aforementioned application is connected to a control system 30 and also is preferably an industry wide standard connector for the same reasons as for using a standard connector for the first connector 20. The second connector 24 joins the cordset 10 to the control system 30 that is located external of the cylinder and is in the atmospheric pressure where the signals representing the position of the piston are received and interpreted to use those signals for the desired purpose.

There is a casing 32 that is secured to the electrical conductor 12 intermediate the first and second ends 16, 18. The casing 32 is a generally elongated housing structure with opposite ends and having C-shaped openings 34 in the opposite ends thereof and is preferably a rectangular cross section having three solid sides 38 and an open side 40. The electrical conductor 12 is affixed to the casing 32 by means of grommets 36 (only one of which is shown) and the grommet 36 may be a separate component that is sealed to the external surface of the electrical conductor 12 or may be molded into the outer covering 14 of the electrical conductor 12.

In any event, the grommet 36 has a peripheral groove that interfits with the internal edge of the C-shaped opening 34 so that the grommet 36 can be slid into the position shown in FIG. 1 and the grommet 36 sealingly affixes the electrical conductor 12 to the casing 32. The same procedure is used to secure the electrical conductor 12 to the opposite end of the casing 32 that is not shown in FIG. 1.

Alternatively, the opening in the casing 32 may be circular and the grommets are of a round configuration with a groove formed in the outer peripheral edge of the grommets.

Figure 2:
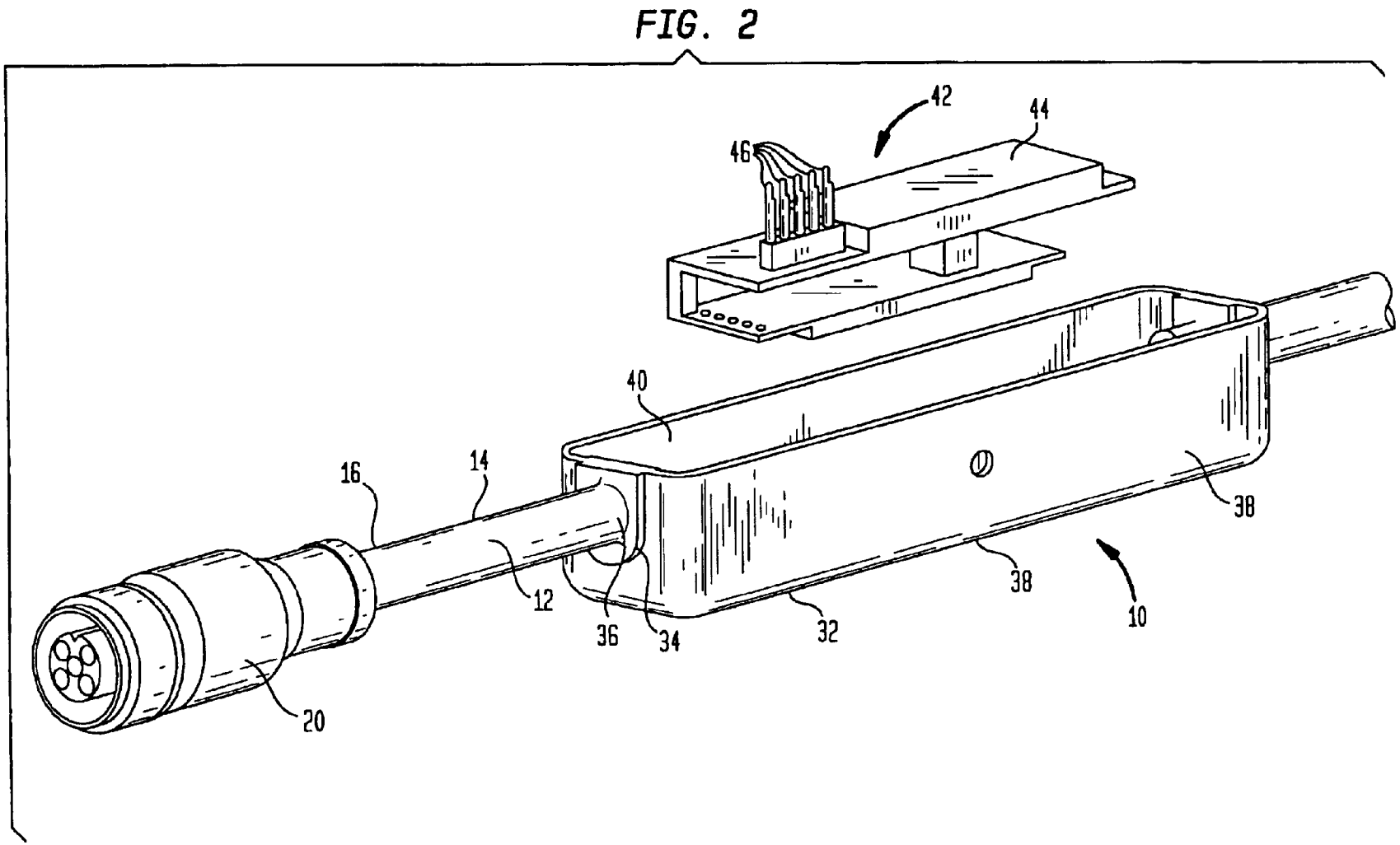
FIG. 2 is an exploded view of the cordset of FIG. 1 showing the installation of signal conditioning circuitry.

Turning now to FIG. 2, there is shown an exploded view of the cordset 10 of the present invention and illustrating the open side 40 of the casing 32. There can be seen electronic circuitry 42 that is basically signal conditioning circuitry used to modify and condition the signals that pass through the electrical conductor 12 between the position sensor 26 and the control system 30 (FIG. 1). Thus, the electronic circuitry 42 is wired into the electrical conductor 12 and may include a printed circuitboard 44 such that the electronic components and the connections to join the printed circuitboard 44 are all enclosed within the casing 32 when assembled. As also can be seen, there are a plurality of pins 46 that extend upwardly from the printed circuitboard 44 and which connect to various components within the electronic circuitry 42.

Figure 3:
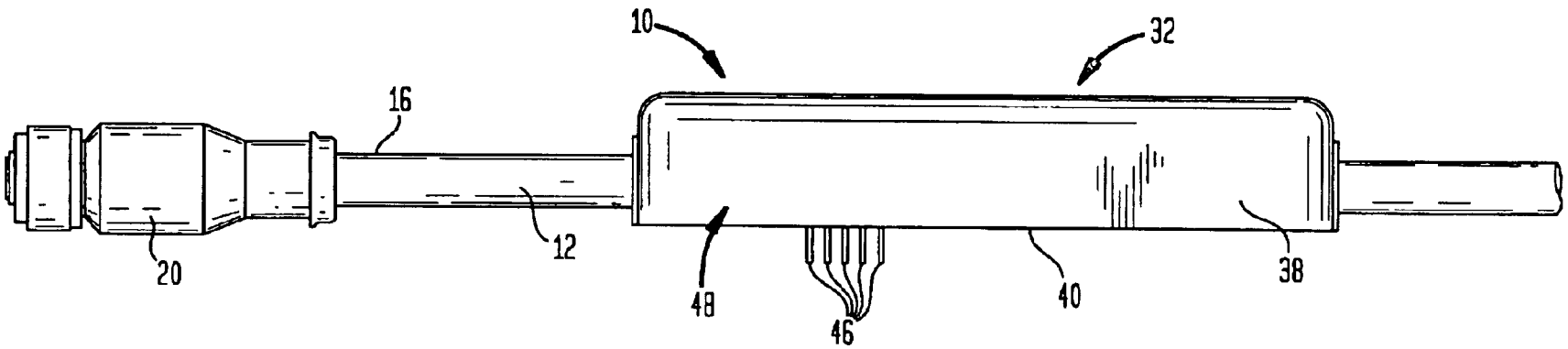
FIG. 3 is a side view of the cordset showing conductive pins extending therefrom.

Turning next to FIG. 3, taken along with FIG. 2, there is shown a side view of the cordset 10 of the present invention and illustrating the pins 46 that extend outwardly from the casing 32 when the printed circuitboard 44 has been inserted into the casing 32. In this orientation, the freely extending pins 46 can be used to test the electronic circuitry 42 within the casing 32 and, when the testing has been completed, the pins 46 are cut off below the upper surface of the casing 32 such that no component extends outwardly from the casing 32.

Accordingly, after the pins 46 have been cut off and no longer appear extending outwardly from the casing 32, the casing 32 is filled with a potting compound 48 such that the printed circuitboard 44, including all electronic components and the connections therebetween are immersed in the potting compound 48 that fills the casing 32 and seals the components within the casing 32 to be impervious to weather or a other hostile conditions in the surrounding atmosphere. When the potting compound 48 is hardened, the potting compound 48 also retains the electrical conductor 12 to the casing 32.

Thus, the final cordset 10 is readily constructed and which has two ends having industry standard electrical connectors and has a casing 32 located intermediate the connectors wherein the casing 32 contains signal conditioning circuitry that is safely potted within the casing 32 and is therefore integrally connected thereto. The ultimate cordset 10 is sufficiently rugged to withstand adverse conditions and yet is produced economically to be used in the cost competitive industry to which the cordset 10 is intended.

It is to be understood that the invention is not limited to the illustrated and described form of the invention contained herein. It will be apparent to those skilled in the art that various changes may be made without departing form the scope of the invention and the invention is not considered limited to what is shown in the drawings and described in the specification.

What is claimed is:

1. An electrical cordset for connecting to a sensor connector of an electrical sensor, the cordset comprising an electrical conductor having a first end and a second end, the first end having an electrical connector connectable to the sensor located within a hydraulic or pneumatic cylinder, a casing attributed to the electrical conductor intermediate the first and the second ends, electrical circuitry connected to the electrical conductor and contained within the casing.

2. The electrical cordset as defined in claim 1 wherein the casing contains a potting compound to seal the electrical circuitry within the casing and to affix the casing to the electrical connector.

3. The electrical cordset as defined in claim 1 wherein the electrical circuitry includes a printed electrical circuitboard to condition electrical signals carried by the electrical conductor.

4. The electrical connector as defined in claim 1 wherein the casing is an elongated configuration having a generally rectangular cross section having three solid sides and one open side.

5. The electrical cordset as defined in claim 1 wherein the electrical conductor has electrical shielding to protect the electrical conductor from electromagnetic interference.

6. The electrical cordset as defined in claim 5 wherein the casing is comprised of a conductive material and is electrically connected to the electrical shielding of the electrical conductor.

7. The electrical cordset as defined in claim 5 where the casing is comprised of a stamped metal material.

8. The electrical cordset as defined in claim 7 wherein grommets are affixed in the openings and sealed against the electrical conductor.

9. The electrical cordset as defined in claim 1 wherein the casing has oppositely disposed ends having openings through which the electrical conductor enters the casing.

10. The electrical cordset as defined in claim 8 wherein the openings are C-shaped openings.

11. The electrical cordset as defined in claim 1 wherein the electrical connector at the first end of the electrical cordset is an industry standard electrical connector.

12. The electrical cordset as defined in claim 11 wherein the connectors at both ends or the electrical cordset are industry standard connectors and wherein at least one of the connectors is a standard M12 connecter.

13. A system for determining the position of a piston within a cylinder, the system comprising a position sensor located within the cylinder to determine the position at the piston and to produce electrical signals representative of that signal, a control system located external of the cylinder to interpret the signals from the position sensor, and an electrical cordset providing electrical communication between the position sensor and the control system, the cordset comprising an electrical conductor having a first end and a second end, the first end having an electrical connector connectable to the position sensor, a casing affixed to the electrical conductor intermediate the first and second ends, and electrical circuitry connected to the electrical conductor and contained within the casing.

14. The system as defined in claim 13 wherein the casing contains a potting compound to seal the electrical circuitry within the casing and affix the casing to the electrical conductor.

15. The system as defined in claim 13 wherein the casing is an elongated body having oppositely disposed ends with openings in each of the ends through which the electrical conductor enters the casing.

16. The system as defined in claim 15 wherein grommets are affixed in openings and sealed against the electrical conductor.

17. The system as defined in claim 16 wherein the grommets have a peripheral groove and the grove interacts with the internal edge of the openings.

* * * * *